US009359123B2

(12) United States Patent
Bhattacharjee et al.

(10) Patent No.: US 9,359,123 B2
(45) Date of Patent: Jun. 7, 2016

(54) CHILD RESISTANT CARTON

(75) Inventors: Tirtharup Bhattacharjee, Kolkata (IN); Parvez Akhtar, New Delhi (IN)

(73) Assignee: WOCKHARDT LIMITED, Bandra East, Mumbai (IN)

( * ) Notice: Subject to any disclaimer, the term of this patent is extended or adjusted under 35 U.S.C. 154(b) by 788 days.

(21) Appl. No.: 13/384,545

(22) PCT Filed: Aug. 16, 2010

(86) PCT No.: PCT/IB2010/053677

§ 371 (c)(1),
(2), (4) Date: Mar. 11, 2012

(87) PCT Pub. No.: WO2011/021138

PCT Pub. Date: Feb. 24, 2011

(65) Prior Publication Data

US 2012/0152779 A1 Jun. 21, 2012

(30) Foreign Application Priority Data

Aug. 17, 2009 (IN) ..... 1879/MUM/2009

(51) Int. Cl.
*B65D 83/04* (2006.01)

(52) U.S. Cl.
CPC ..... *B65D 83/0463* (2013.01); *B65D 2215/02* (2013.01)

(58) Field of Classification Search
CPC ..... B65D 83/0463; B65D 2215/02
USPC ..... 229/125.125, 913; 206/1.5, 531, 532, 206/539
See application file for complete search history.

(56) References Cited

U.S. PATENT DOCUMENTS

| | | | | |
|---|---|---|---|---|
| 4,561,544 | A * | 12/1985 | Reeve | 206/1.5 |
| 5,934,114 | A * | 8/1999 | Weisburn et al. | 206/1.5 |
| 6,460,693 | B1 * | 10/2002 | Harrold | 206/1.5 |
| 7,389,875 | B2 * | 6/2008 | Sandberg et al. | 206/531 |
| 7,658,287 | B2 * | 2/2010 | Hession | 206/528 |
| 8,297,436 | B2 * | 10/2012 | Gattefosse et al. | 206/1.5 |
| 8,453,840 | B2 * | 6/2013 | Wharton | 206/531 |
| 2006/0131205 | A1 * | 6/2006 | Sandberg et al. | 206/538 |
| 2007/0272586 | A1 * | 11/2007 | Hession | 206/532 |
| 2008/0217205 | A1 * | 9/2008 | Sattel et al. | 206/531 |
| 2009/0184023 | A1 * | 7/2009 | Brollier et al. | 206/531 |

* cited by examiner

*Primary Examiner* — Gary Elkins
(74) *Attorney, Agent, or Firm* — Bio Intellectual Property Services LLC; O. (Sam) Zaghmout

(57) ABSTRACT

The present invention relates to improved child resistant carton and methods for using the same. The improved child resistant carton comprises housing (1) and an insert (4). The housing comprises a locking mechanism (3). The housing (1) may be made from multiple panels. The panel may be of any shape and may be more than one. The housing (1) may be made of card board. The locking mechanism (3) is characterized in that the locking and releasing of the carton has improved child resistance characteristics.

6 Claims, 13 Drawing Sheets

CHILD RESISTANT CARTON

FIELD OF THE INVENTION

Figure 1:
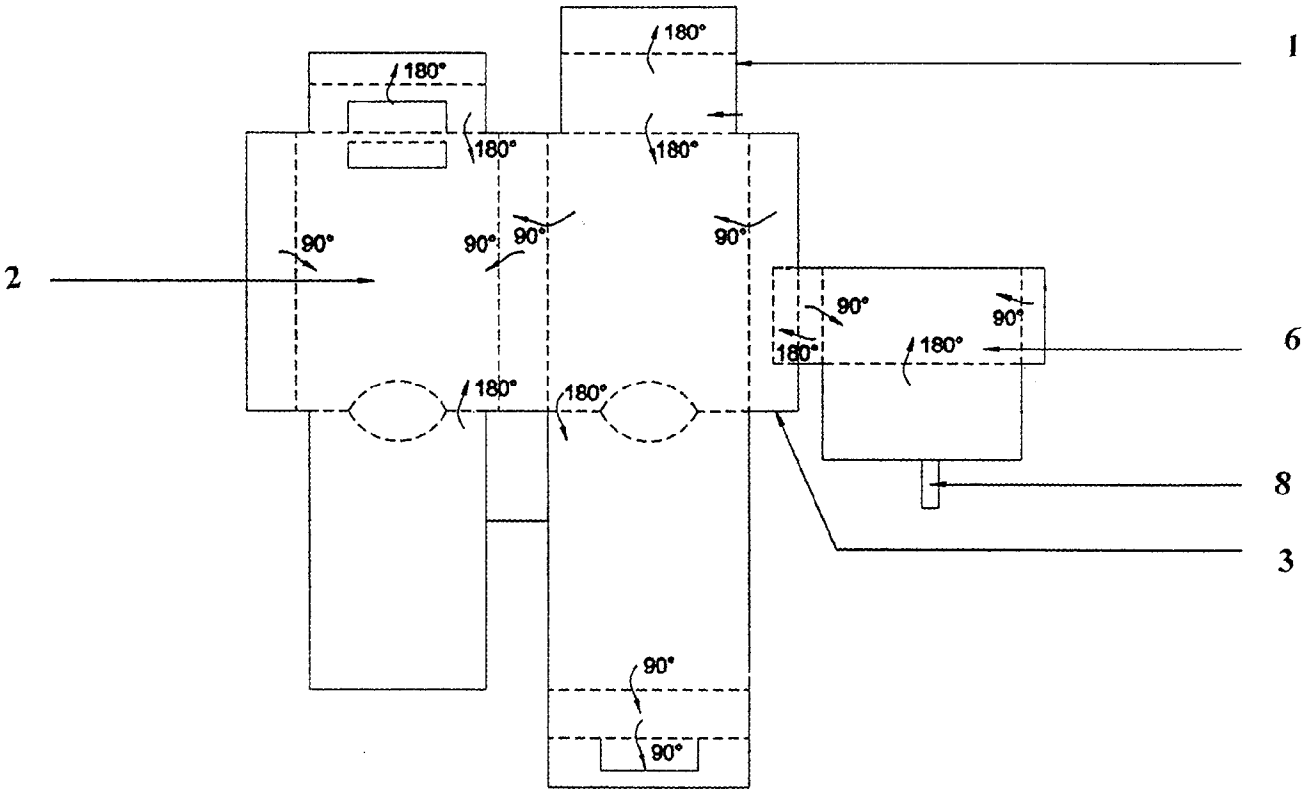

The present invention relates to improved child resistant carton and methods for using the same. The improved child resistant carton comprises housing and an insert. The housing comprises a locking mechanism. The housing may be made from multiple panels. The panel may be of any shape and may be more than one. The housing may be made of card board. The locking mechanism is characterized in that the locking and releasing of the carton has improved child resistance characteristics.

BACKGROUND OF THE INVENTION

Child resistant blisters are well known in the prior art. Many a times, child resistant blisters are prohibitively expensive. Instead, child resistant carton comprising the blisters are the emerging trends. These features are known in the prior art. The present invention relates to improved child resistant carton and methods for using the same. The child resistant features should be durable and reliable but nonetheless easily operated by adults. Preferably, the carton may be operated to repeatedly access the contents thereof. These are less expensive and yet are effective child resistant ones.

U.S. Pat. No. 7,090,079 relates to produce a package, for example for pharmaceutical preparations, in which the contents are better protected against children gaining access which is as good after repeated openings and closings as on the first opening.

U.S. Pat. No. 6,491,211 relates to cartons, and, more particularly, to child resistant cartons and method for using the same.

U.S. Pat. No. 5,275,291 relates to Child resistant elderly friendly tablet dispensing container.

U.S. Pat. Nos. 6,047,829, 6,230,893, 6,412,636 relate to a unit dose packaging system (UDPS) having a child resistant locking feature.

U.S. Pat. No. 6,752,272 relates to a unit dose packaging system (UDPS) with exterior pocket feature.

U.S. Pat. No. 6,913,149 relates to a unit dose packaging system (UDPS) with molded locking feature.

U.S. Pat. No. 6,951,282 relates to peel away tab child resistant package.

U.S. Pat. No. 7,216,776 relates to child resistant pill dispenser.

U.S. Pat. Nos. 7,401,702, 5,437,371, 5,129,527, 6,409,020 relate to child resistant blister package.

U.S. Pat. No. 6,394,275 relates to child resistant package.

U.S. Pat. No. 6,173,838 relates to child resistant medication compact.

U.S. Pat. No. 6,523,691 relates to child resistant closure.

US application No. 20040099565 relates to a carton package of fiber-based material for pharmaceutical etc. that overcomes the structural weakness problem of the prior art.

US application No. 20070235368 and 20090045096 relate to a child resistant, senior friendly unit dose container.

US application No. 20080093252 relates to blister card for child-resistant package.

US application No. 20080135606 relates to apparatus and method for holding and protecting drug delivery devices.

SUMMARY OF THE INVENTION

The present inventors while working for an improved child resistant carton comprising ordinary blister have found that there is a need for child resistant features which are durable and reliable. The child resistant features on the carton comprise an improved locking mechanism with the feature of engaging and releasing means for non access or access of the insert comprising pharmaceutically active ingredient in tablet or capsule form. The main features of the improved child resistant carton and locking mechanism may be (i) child resistant and yet easy to operate by an adult. (ii) Repeated opening and closing of the locking mechanism. (iii) Child resistant carton may be easier and less expensive to manufacture. The insert may be an ordinary blister. The blister may be located on the tray inside the housing of carton.

The pharmaceutically active ingredient refers to a therapeutically active compound, as well as any prodrugs thereof and pharmaceutically acceptable salts, hydrates and solvates of the compound and the prodrugs. It may include one or more of amlodipine, sertraline, zolpidem, cetrizine, lisnopril, enalapril, terbinafine, phenytoin sodium, bupropion, diclofenac sodum, diltiazem hydrochloride, donepezil hydrochloride, duloxetine hydrochloride, famotidine, ropinirole, divalproex, entacapone, carbidopa, levodopa, eszopiclone, felodipine, fenofibrate, lansoprazole, metoprolol succinate, pantoprazole, pregabalin, vancomycin hydrochloride, mycophenolate, olanzapine, azithromycin, quetiapine, rabeprazole, ropinirole, fexofenadine, levetiracetam, ramipil, risperidone, ranitidine, tamsulosin hydrochloride, ziprasidone, topiramate, valacyclovir, venlafaxine, memantine and lamotrigine and the like.

The details of one or more embodiments of the inventions are set forth in the description below. Other features, objects and advantages of the invention will be apparent from the description and claims.

DETAILED DESCRIPTION OF THE DRAWINGS

FIG. 1 Carton housing blank outline

Figure 2:
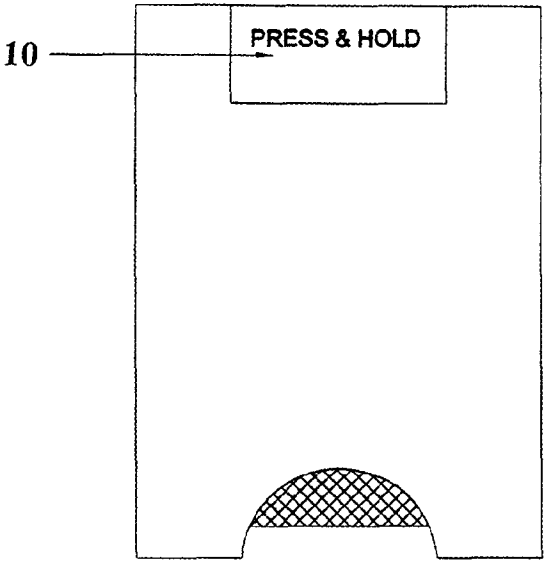

FIG. 2 Top view of the formed carton housing along with blister

Figure 3:
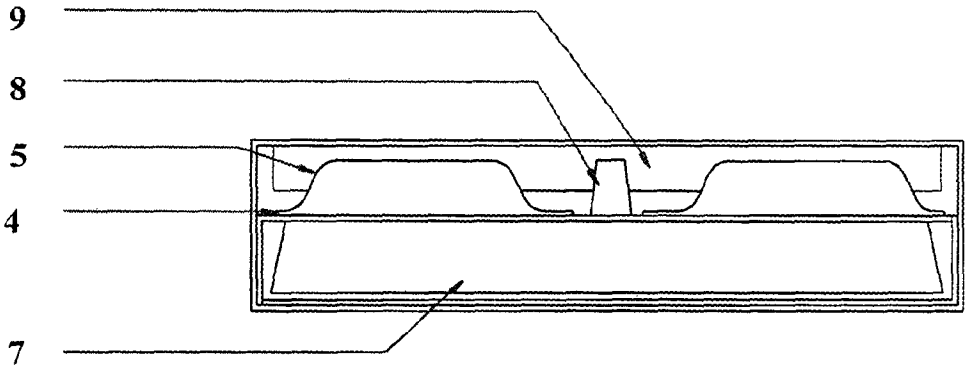

FIG. 3 Front view of carton housing detailing the various parts

Figure 4:
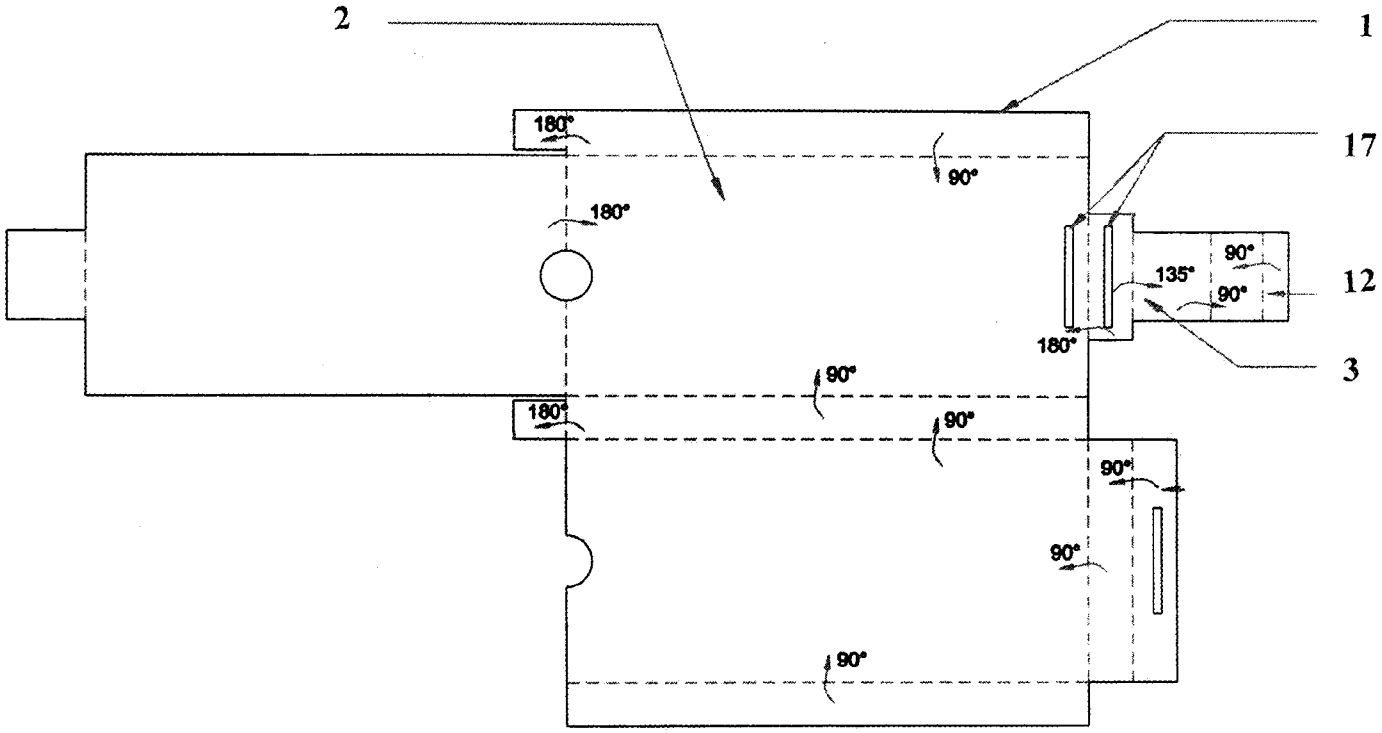

FIG. 4 Carton housing blank outline

Figure 5:
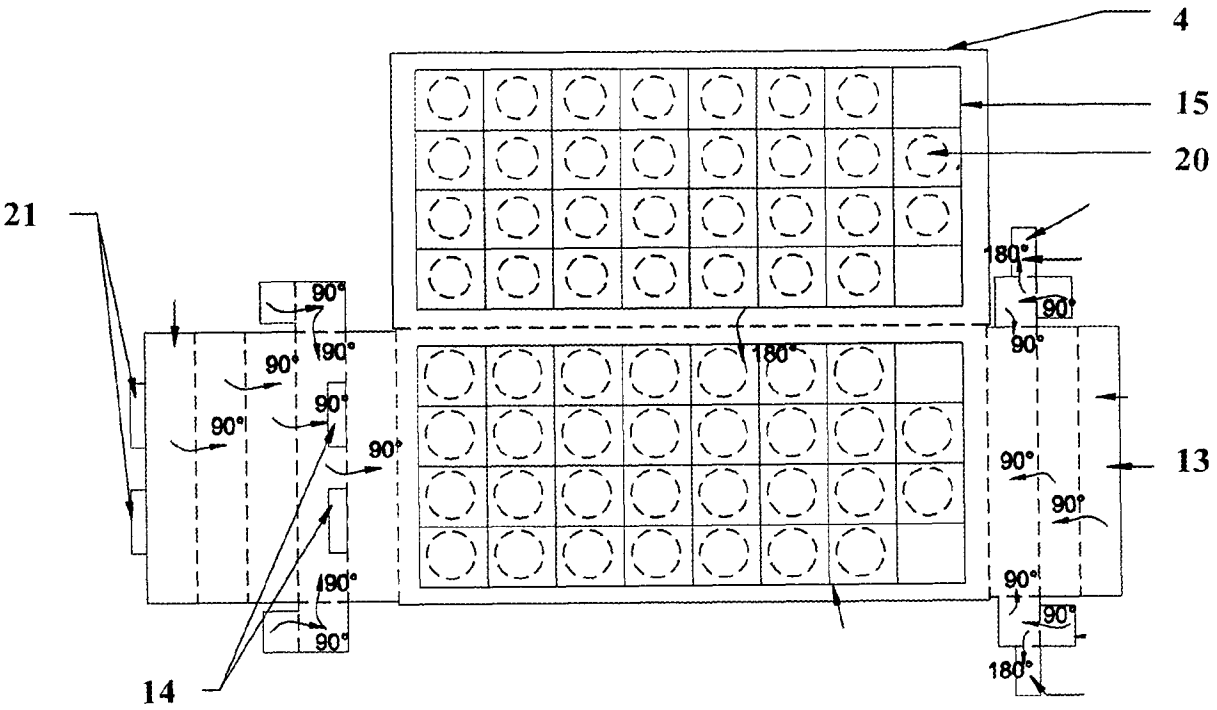

FIG. 5 Carton tray blank outline

Figure 6:
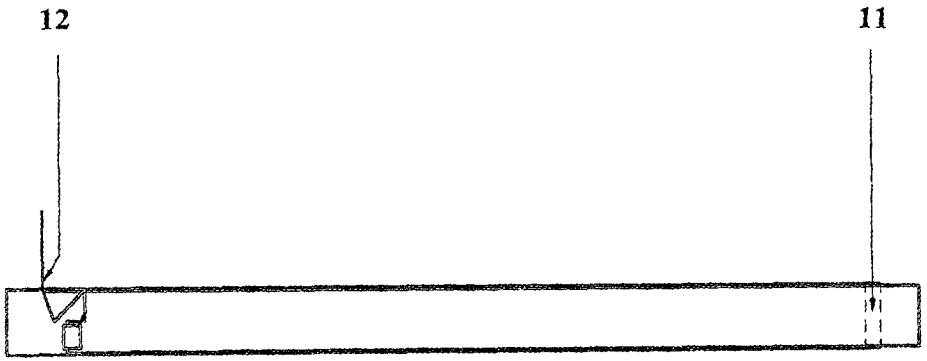

FIG. 6 Side view of carton housing detailing the function

Figure 7:
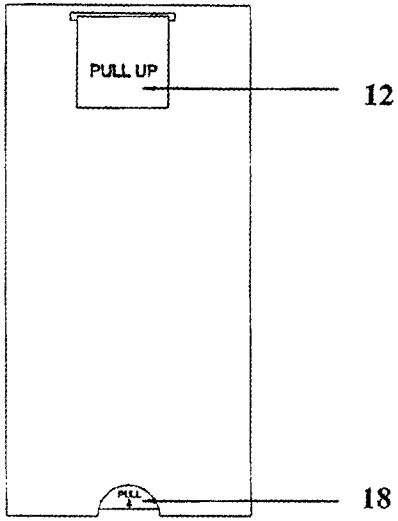

FIG. 7 Top view of carton housing

Figure 8:
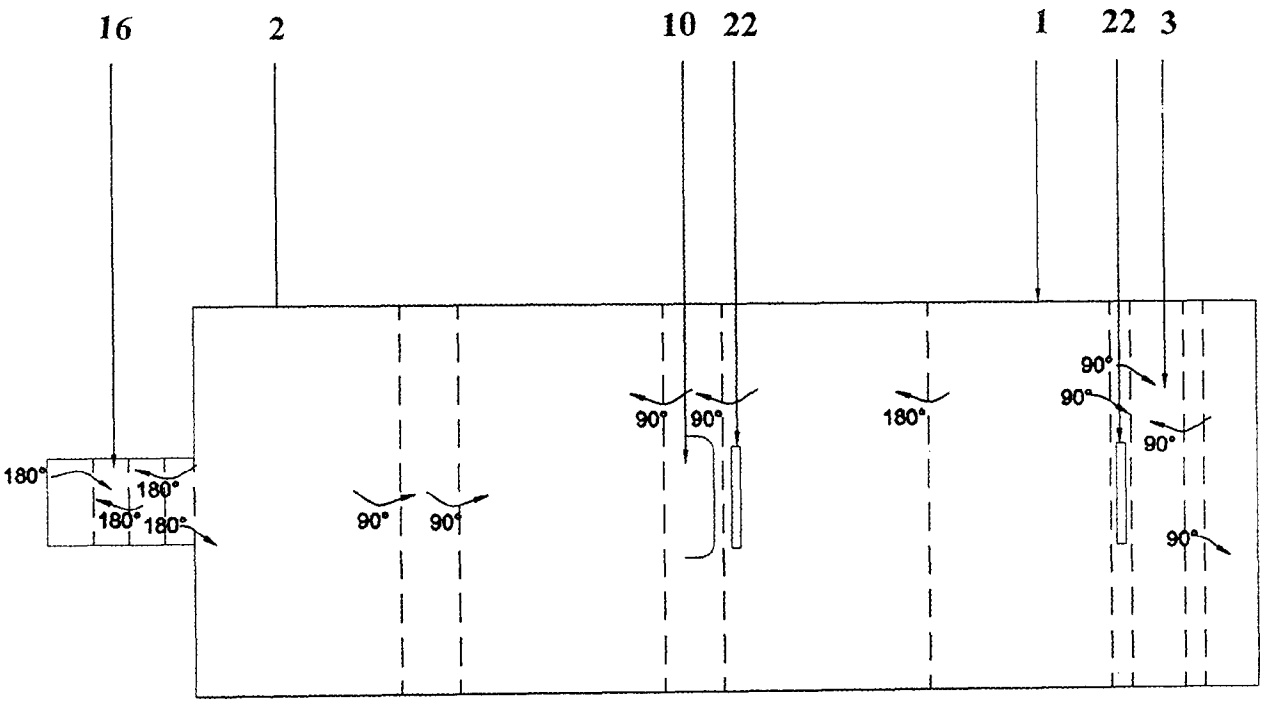

FIG. 8 Carton blank outline

Figure 9:
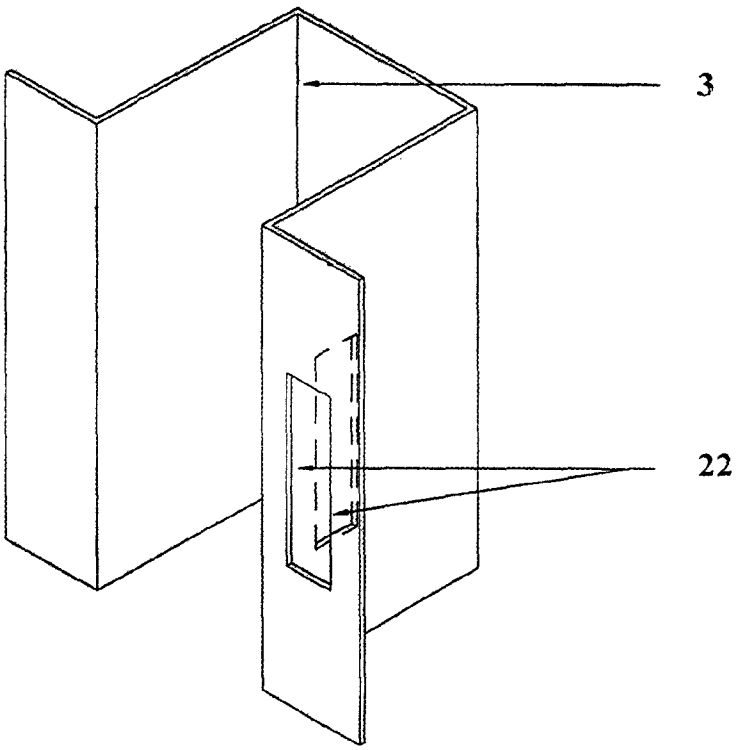

FIG. 9 Perspective view of the locking mechanism

Figure 10:
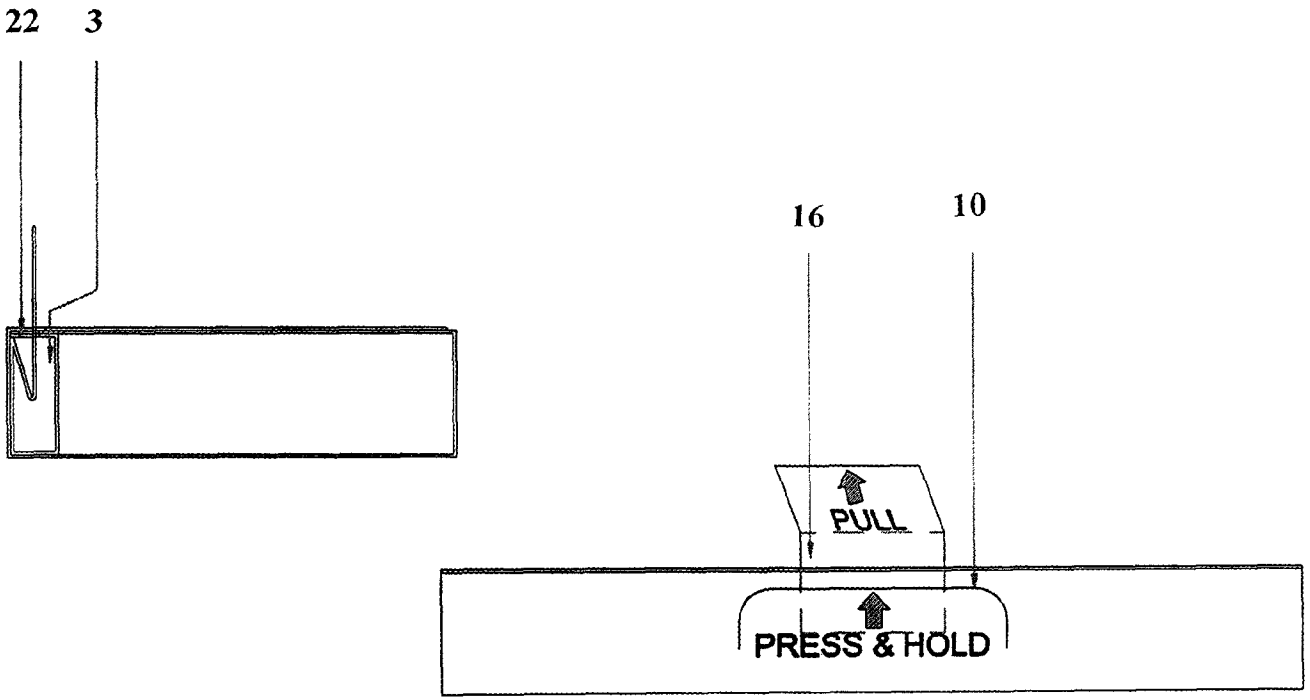

FIG. 10 Front and side view detailing the carton function

Figure 11:
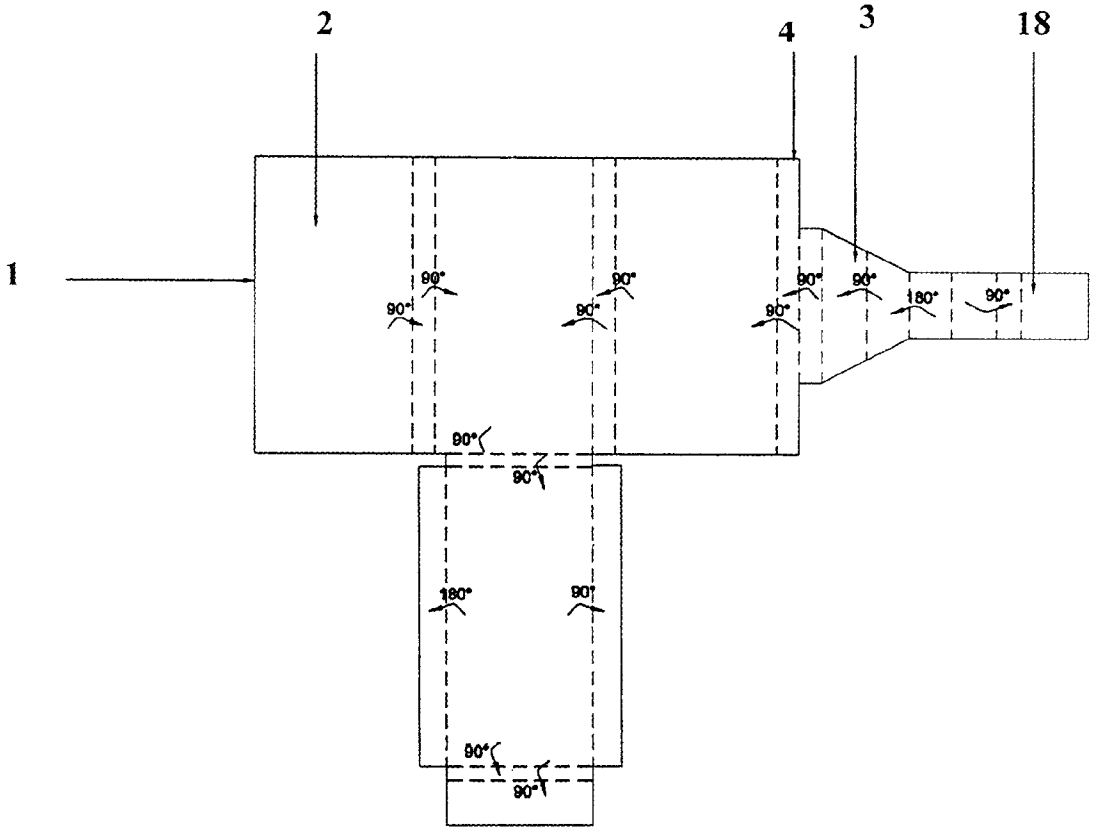

FIG. 11 Carton blank outline

Figure 12:
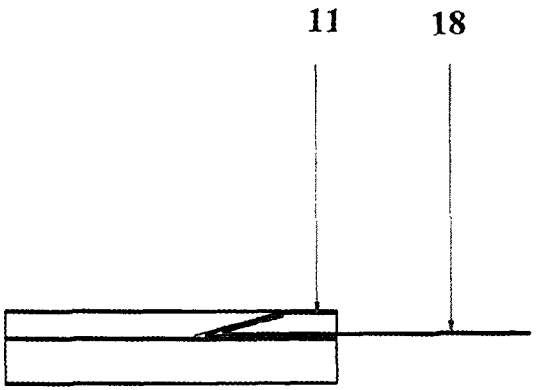

FIG. 12 Side view after insertion of the locking mechanism for carton

Figure 13:
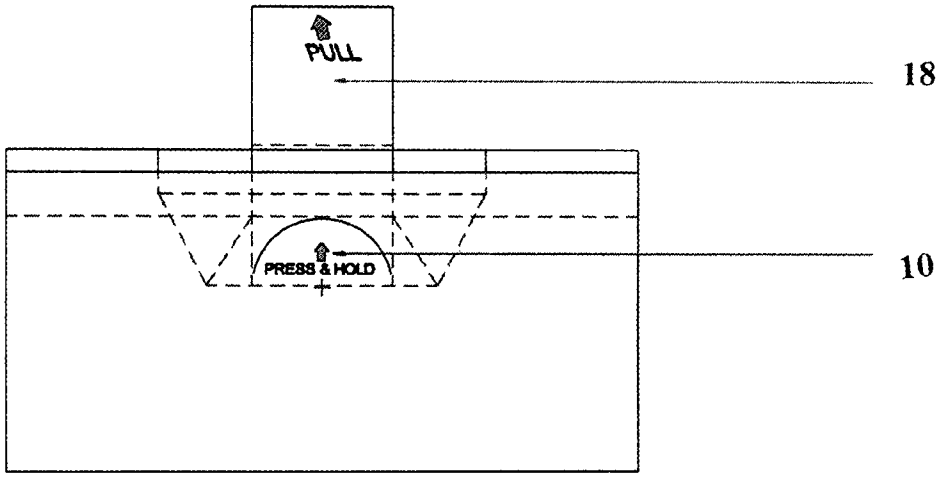

FIG. 13 Top view of the carton after insertion of the locking mechanism

Embodiments of the improved child resistant carton may include one or more of the following features. An improved carton comprises housing and an insert. The housing comprises a locking mechanism. The housing may be made from multiple panels. The panel may be of any shape such as rectangular, square, trapezoid or any other combinations. The multiple panels may be more than one preferably 3 or 4 numbers. The housing may have an open end to let or take out the insert out of the housing. The housing may be made of card board.

The card board material for use in the invention may be folding box board of weight in the interval 170 to 500 g/m$^2$ (Grams per square meter), preferably 200 to 400 g/m$^2$. The card board used may be within the thickness range of 0.2 mm to 1 mm. The coating may provide a high degree of smoothness and superior graphic print surface.

All the above features regarding the carton, housing, insert, shape, material of construction, thickness of material and coating are applicable to all the embodiments of the improved child resistant carton detailed below.

One of the embodiments of the carton is shown in FIG. 1, FIG. 2 & FIG. 3. The housing (1) may be made from cardboard materials blank comprising plurality of panels (2) known as carton housing blank outline as shown in FIG. 1. Panels may be of any shape such as rectangular, circular, and trapezoidal or any other shape. The card board material may be a single blank. The blank may be of 200-400 gsm (Grams per square meter) with printable outer surface. The panel (2) comprises the part "press and hold" (10) on one side and vertical obstacle (9) on the other as shown in FIG. 3. Back portion of the housing (1) comprises the flexible bottom support (7) as shown in FIG. 3. Locking mechanism (3) comprises horizontal resting rack (6) with notch (8) is shown in FIG. 1. This may act as a support to the insert (4) and may not allow it come out.

Filled insert (4) with groove may be inserted inside the housing (1) properly. The insert (4) may get stuck in the vertical obstacle (9) and may not come out on pulling.

To bring out the insert, the cut part "press and hold" (10) may need to be pressed which in turn may press the back portion of the insert (4). The bottom flexible bottom support (7) may provide an opposite thrust while gripping the insert tightly.

While holding the cut part"press and hold", the insert (4) may need to be pulled out. The pressing may allow the insert (4) to slip under the vertical obstacle (9). The insert (4) then slides over the horizontal resting rack (6) while the notch (8) in the resting rack may not allow the insert (4) to come out of the housing.

Edges of the panels (2) may have to be folded as shown in the FIG. 1. The various folding of panels (2) are either at 90° or 180° and the directions are shown by arrows. Panels (2) may be joined or bonded to form housing. Bonding between the two surfaces may be achieved by the glue. The various surfaces bonding are achieved by glues (19). An insert (4) may be a pack of blister (5) comprising one or more rows of tablet or capsule. Insert (4) may be provided with a groove in between the rows of tablet or capsule. Blister (5) may be of any shape such as trapezoidal, rectangular, and circular or any other shape.

When the "Press and hold" (10) may be pressed as shown n FIG. 2, it may release the horizontal resting rack (6) facilitating easy withdrawal of the insert(4) when pulled, for removal of tablet or capsule. After removal of the tablet or capsule, the insert (4) may be pushed back into the housing and the above operation may be repeated. This locking and releasing mechanism of the carton facilitate improved child resistant character to the carton.

Another embodiment of the carton is shown in FIG. 4, FIG. 5, FIG. 6 and FIG. 7. The housing (1) may be made from cardboard materials, comprising multiple pluralities of panels (2). Panels (2) may be of any shape such as rectangular, circular, and trapezoidal or any other shape. The embodiment shown in FIG. 4 comprises two panels (2). By affecting various folds either at 90° and 180° from the arrows as shown in FIG. 4, multiple panels (2) together form the housing (1). Bonding between the two surfaces may be achieved by the glue. The various surfaces bonding are achieved by glues (19) bonding as shown in FIG. 4 & FIG. 5. A flexible pull up (12) of the shape as shown in FIG. 6 may be provided on the inside surface of panel (2) at the back end of the housing. A locking mechanism (3) which comprises multiple grooves (17) is shown in FIG. 4. In the embodiment shown there are two grooves. Stoppers (11) may be provided on the panel (2) as shown in FIG. 4. FIG. 5 shows the carton tray (13) blank outline. Carton tray blank outline comprises three parts namely back part of the tray (13), front part of the tray (13) and tray card with cavities (20) to hold the blisters. The tray comprises card cold seal track (15) with cavities (20). Front part of tray (13) comprises locks (21) and locking grooves (14). The locking mechanism may be achieved by carrying out the various folds at 90° as shown by the arrows. Back part of the tray comprises various folds at 90° and 180° as shown by the arrows in FIG. 5. Back part of the tray (13) may be smaller in height than the front part of tray (13). A carton tray blank outline as shown in FIG. 5 may be provided inside the housing. The tray (13) may be made of cardboard material and may be slid able one inside the housing. The tray may be the insert (4) or hold the insert (4) comprising the blisters. The insert (4) may be the strip of blister.

An insert (4) may be placed inside the tray. The tray may be inserted into the housing (1) from the front end to back end of the housing. The blister (5) may be placed in the tray with raised part suitably jammed in the punched hole. Blister (5) may be of any shape such as trapezoidal, rectangular, and circular or any other shape. The tray may be then closed and sealed. The filled tray may be pushed inside the housing (1). As shown in FIG. 5, the glues (19) achieve the various surfaces bonding of the back part of the tray (13).

When the flexible pull up (12) may be pulled upside, the inside locking mechanism (3) may be raised and may release the back portion of the inside tray card. When the front part of the tray (13) may be pulled outside by pull (18), the whole tray card may come out. After removing the pharmaceutically active ingredient from the tray cavities, the tray may again be pushed inside by (18), which may result in the back part of the tray (13) pushing the locks (21) which may slip and may get locked. This operation may be repeated many times. This locking and releasing mechanism of the carton facilitate improved child resistant character to the carton.

Another embodiment of the carton is shown in FIG. 8, FIG. 9 & FIG. 10 respectively. The housing (1) may be made from cardboard materials, comprising preferably plurality of panels (2). The carton of this embodiment may be made from 3 panels and each panel may be of any shape such as rectangular, circular, and trapezoidal and any other shape. The carton may comprise the locking mechanism (3). The locking mechanism (3) may get into desired shape as the carton may be folded either by 90° or 180° along the arrows shown in FIG. 8. The locking mechanism (3) may comprise the following part namely two silted grooves (22), one pull tab (16) and a press and hold tab (10).

The carton may get locked when the pull tab (16) passes through the two silted grooves (22) and its edge may get stuck inside the locking mechanism (3). The carton may be opened by pressing the press and hold (10) and at the same time pulling the pull tab (16). By this operation lock may get released and may be positioned itself from the grooves. As the pull tab (16) may be pulled upward, the carton may get opened. This locking and releasing mechanism of the carton facilitate improved child resistant character to the carton. The insert may be accommodated in the extension of any of the three panels. Bonding between the two surfaces may be achieved by the glue. The various surfaces bonding are achieved by glues (19) as shown in FIG. 8 & FIG. 9.

Another embodiment of the carton is shown in FIG. 11, FIG. 12 & FIG. 13. The housing (1) may be made from cardboard materials, comprising preferably plurality of panels (2) comprising three or more. Panels may be of any shape such as rectangular, circular, and trapezoidal and any other shape. The embodiment shown in FIG. 11 may be made from four panels (2) and each panel may be of rectangular or any other shape. Panel (2) has an extension which forms part of the locking mechanism (3) as shown in FIG. 11. FIG. 11 shows the panels (2) and their folding pattern either by 90° or 180° and their direction by arrows. The formation of the carton by this folding pattern may get the locking mechanism (3) into shape. Bonding between the two surfaces may be achieved by the glues (19). The various surfaces bonding are achieved by glues (19) as shown in FIG. 11. FIG. 12 & FIG. 13 represents the carton functioning. FIG. 12 depicts the locking mechanisms (3) which comprises the component press and hold (10) and pull (18). The insert (4) may be accommodated in the extension of the first three panels (2). The fourth panel (2) may be an extension of the locking mechanism (3); the panel (2) may house the press and hold (10) and the stopper (11).

The carton may get locked when the pull (18) slips inside the panel (2) and may get stuck with the stopper (11). The carton may be opened by pressing the press and hold (10). This operation may push the locking mechanism (3) which may get released. At this juncture the pull (18) tab may be pulled outside and the carton may get opened.

This locking and releasing mechanism of the carton facilitate improved child resistant character to the carton.

While the present invention has been described in terms of its specific embodiments, certain modifications and equivalents will be apparent to those skilled in the art and are intended to be included within the scope of the present invention.

The invention claimed is:

1. A carton comprising: (a) a housing (1) and an insert (4); wherein said housing made of card board material; wherein said insert (4) comprising blisters (5) arranged in rows; wherein said blister comprising a tablet or a capsule; wherein said housing (1) provided with a press and hold tab (10), a horizontal resting rack (6), a notch (8), a support (7), and a vertical obstacle (9); wherein said housing provided with a locking mechanism (3) for the insert (4); the locking mechanism (3) characterized in that the horizontal resting rack (6) acts as support (7) to the insert (4) and the insert (4) gets stuck on the vertical obstacle (9) locking the insert (4).

2. The carton according to claim 1, wherein pressing the press and hold (10) allows the insert (4) to slip under the vertical obstacle (9) and slides over the horizontal resting rack (6) releasing the lock for access to the insert (4) and which insert (4) locking in the notch (8).

3. The carton according to claim 1 wherein the blister comprises pharmaceutically active ingredients.

4. The carton according to claim 1, wherein the housing (1) is made of multiple panels (2).

5. The carton according to claim 1, wherein the panels (2) are of rectangular, circular, rapezoidal or any other shape.

6. The carton according to claim 1, wherein the weight of card board material is in the range 170 grams per square meter to 500 grams per square meter.

* * * * *